US008716207B2

(12) United States Patent
Blattner et al.

(10) Patent No.: US 8,716,207 B2
(45) Date of Patent: May 6, 2014

(54) SOLIDIFICATION MECHANISM INCORPORATING IONIC LIQUIDS

(75) Inventors: Amanda Ruth Blattner, Prior Lake, MN (US); Charles Allen Hodge, Cottage Grove, MN (US)

(73) Assignee: Ecolab USA Inc., St Paul, MN (US)

( * ) Notice: Subject to any disclaimer, the term of this patent is extended or adjusted under 35 U.S.C. 154(b) by 60 days.

(21) Appl. No.: 13/488,497

(22) Filed: Jun. 5, 2012

(65) Prior Publication Data

US 2013/0324455 A1 Dec. 5, 2013

(51) Int. Cl.

| | |
|---|---|
| ***C11D 17/00*** | (2006.01) |
| ***C11D 17/06*** | (2006.01) |
| ***C11D 1/62*** | (2006.01) |
| ***C11D 3/08*** | (2006.01) |
| ***C11D 3/20*** | (2006.01) |
| ***B08B 7/00*** | (2006.01) |

(52) U.S. Cl.

USPC ..... 510/108; 510/180; 510/191; 510/214; 510/238; 510/445; 510/446; 510/504; 510/511; 134/2; 134/42

(58) Field of Classification Search

USPC ..... 510/511, 108, 180, 191, 214, 238, 445, 510/494, 504, 446; 134/2, 42

See application file for complete search history.

(56) References Cited

U.S. PATENT DOCUMENTS

| | | | | |
|---|---|---|---|---|
| 4,141,841 | A * | 2/1979 | McDanald | 510/330 |
| 4,165,293 | A | 8/1979 | Gordon | |
| 4,259,217 | A | 3/1981 | Murphy | |
| 4,339,335 | A | 7/1982 | Wixon | |
| 4,615,814 | A * | 10/1986 | Winetzky | 510/308 |
| 4,720,383 | A * | 1/1988 | Drach et al. | 424/70.21 |
| 4,793,943 | A | 12/1988 | Haslop et al. | |
| 4,830,782 | A | 5/1989 | Broze et al. | |
| 4,871,467 | A | 10/1989 | Akred et al. | |
| 5,116,520 | A * | 5/1992 | Lichtenwalter et al. | 510/520 |
| 6,039,936 | A | 3/2000 | Restle et al. | |
| 6,491,840 | B1 | 12/2002 | Frankenbach et al. | |
| 6,531,270 | B1 | 3/2003 | Olson et al. | |
| 6,531,273 | B1 | 3/2003 | Olson et al. | |
| 6,586,166 | B1 | 7/2003 | Olson et al. | |
| 6,605,581 | B1 | 8/2003 | Cao et al. | |
| 6,605,584 | B2 | 8/2003 | Fong et al. | |
| 7,541,320 | B2 | 6/2009 | Dabkowski et al. | |
| 7,718,596 | B2 | 5/2010 | Briggs et al. | |
| 7,776,810 | B2 | 8/2010 | Jordan, IV et al. | |
| 7,786,064 | B1 | 8/2010 | Hecht et al. | |
| 7,786,065 | B2 | 8/2010 | Hecht et al. | |
| 7,858,575 | B2 | 12/2010 | De Block | |
| 7,928,053 | B2 | 4/2011 | Hecht et al. | |
| 7,939,485 | B2 | 5/2011 | Price et al. | |
| 8,071,520 | B2 | 12/2011 | Hodge et al. | |
| 8,481,474 | B1 * | 7/2013 | Blattner et al. | 510/237 |
| 2004/0002438 | A1 | 1/2004 | Hawkins et al. | |
| 2004/0077519 | A1 | 4/2004 | Price et al. | |
| 2005/0143517 | A1 | 6/2005 | Schmidt | |
| 2006/0090271 | A1 | 5/2006 | Price et al. | |
| 2006/0166856 | A1 | 7/2006 | Petrat et al. | |
| 2008/0070966 | A1 | 3/2008 | Elder et al. | |
| 2009/0029887 | A1 | 1/2009 | Schwab et al. | |
| 2009/0036334 | A1 | 2/2009 | Schwab et al. | |
| 2009/0183317 | A1 * | 7/2009 | Meier et al. | 8/137 |
| 2009/0291872 | A1 | 11/2009 | Bara et al. | |
| 2010/0016205 | A1 | 1/2010 | Schwab | |
| 2010/0029519 | A1 | 2/2010 | Schwab et al. | |
| 2010/0115706 | A1 | 5/2010 | Bender | |
| 2010/0297532 | A1 | 11/2010 | Beste et al. | |
| 2011/0021405 | A1 | 1/2011 | Somerville Roberts et al. | |
| 2012/0046216 | A1 | 2/2012 | Hodge et al. | |

FOREIGN PATENT DOCUMENTS

| | | | |
|---|---|---|---|
| DE | 1801141 | A1 | 4/1970 |
| EP | 1790328 | A1 | 10/2006 |
| EP | 1920824 | A1 | 5/2008 |
| GB | 1336556 | | 11/1973 |
| GB | 2133813 | A | 8/1984 |
| GB | 2318362 | A | 4/1998 |
| WO | WO 02102948 | A2 | 12/2002 |
| WO | WO 2006027069 | A1 | 3/2006 |
| WO | WO 2006027070 | A1 | 3/2006 |
| WO | WO 2006111712 | A2 | 10/2006 |
| WO | WO 2007059822 | A1 | 5/2007 |
| WO | WO 2010040917 | A1 | 4/2010 |

OTHER PUBLICATIONS

Bajpai, D., et al., "Synthesis, Characterization and Surface Active Properties of Imidazolinium Surfactant Derived from Oleic Acid and Diethylenetriamine", Novel Surfactants, www.tsdjournal.com, Document No. TS100383, 2008 (6 pages).

Colonial Chemical, Inc., "ColaSolv IES & OES", http://www.colonialchem.com/Products/Household-and-Industrial/ColaSolv/149/ColaSolv . . . [retrieved from Internet on Feb. 22, 2012] (3 pages).

Galante, D.C., et al., "Heavy-Duty Laundry Detergents", JAQCS, Apr. 1981, Tarrytown, New York (7 pages).

Gayet, Florence, "Surfactant Aggregates in Ionic Liquids and Reactivity in Media", International Journal of Chemical Reactor Engineering, vol. 8, Article A38, 2010 (18 pages).

Colonial Chemical, Inc., "Poly SugaBetaine L" http://www.colonialchem.com/Products/Personal-Care/Poly-SugaBetaine/28/Poly-SugaBet . . . [retrieved from Internet on Feb. 22, 2012] (1 page).

Puchta, Rolf, "Cationic Surfactants in Laundry Detergents and Laundry Aftertreatment Aids", JAOCS, vol. 61, No. 2, Feb. 1984 (10 pages).

Wu, Jiapei, "Aggregation Behavior of Polyoxyethylene (2) Sorbitan Monolaurate (Tween 20) in Imidazolium Based Ionic Liquids", American Chemical Society, Langmuir 2008, 24, 9314-9322 (9 pages).

SIBERNAT, Product Information SIBERNAT® 22, Evonik Industries, www.sipernat.com, Feb. 2012, 2 pages.

* cited by examiner

*Primary Examiner* — Lorna M Douyon

(74) *Attorney, Agent, or Firm* — McKee, Voohees & Sease

(57) ABSTRACT

A solid cleaning composition including an ionic liquid and a hardening agent is provided. The compositions are substantially free of alkyl phenol ethoxylates, including nonyl phenol ethoxylates. The solid cleaning compositions remain solid at room temperature despite the inclusion of ionic liquids, providing an effective, biorenewable, environmentally friendly alternative to nonyl phenol ethoxylate cleaning compositions.

17 Claims, No Drawings

SOLIDIFICATION MECHANISM INCORPORATING IONIC LIQUIDS

FIELD OF THE INVENTION

The invention relates to the field of hard surface cleaning compositions, including solid hard surface cleaners. In particular, the invention relates to a hard surface cleaning composition including ionic liquids in a solid composition at room temperatures.

BACKGROUND OF THE INVENTION

The development of solid block cleaning compositions has revolutionized the manner in which detergent compositions are dispensed by commercial and institutional entities that routinely use large quantities of cleaning materials. Solid block compositions offer unique advantages over the conventional liquids, granules or pelletized forms of detergents, including improved handling, enhanced safety, elimination of component segregation during transportation and storage, and increased concentrations of active components within the composition. Because of these benefits, solid block cleaning compositions, such as those disclosed and herein incorporated by reference in U.S. Pat. Nos. RE 32,763, RE 32,818, 4,680,134 and 4,595,520, have quickly replaced the conventional composition forms in commercial and institutional markets.

Various hardening mechanisms have been used in cleaning and sanitizing compositions for converting a fluid composition to a solid mass for containment and modification of the solubility of the active ingredients during use. For example, the active ingredients may be combined with the hardening agent under melting temperatures, commonly referred to as a "molten process," to achieve a homogeneous mixture, and the melt then poured into a mold and cooled to a solid form. Solid alkaline detergent compositions may also be prepared from an aqueous emulsion of detergent ingredients combined with a hardening agent that can hydrate to bind free water in the emulsion which, optionally after heating and cooling, hardens to a solid.

Conventional surfactants in many detergents useful for hard surface cleaning compositions, particularly those intended for institutional and commercial use, generally contain alkyl phenol ethoxylates (APEs). APEs are effective at removing soils containing grease from a variety of surfaces and are thus effective cleansers and degreasers. Commonly used APEs include nonylphenol ethoxylates (NPE) surfactants.

While effective, APEs are disfavored due to environmental concerns. For example, NPEs are formed through the combination of ethylene oxide with nonylphenol (NP). Both NP and NPEs exhibit estrogen-like properties and may contaminate water, vegetation and marine life. NPE is also not readily biodegradable and remains in the environment or food chain for indefinite time periods. There is therefore a need in the art for an environmentally friendly and biodegradable alternative that can replace APEs in hard surface cleaners.

In general, ionic liquids refer to a class of materials including molten salts which remain liquid at temperatures of 100° C. or below. The ionic liquids are described as having to discernible melting point (based on DSC analysis) and are "flowable" at temperatures of about 100° C. or below. Ionic liquids have very low vapor pressure and generate virtually no hazardous vapors. As a result of the charged species comprising the ionic fluids, they provide a highly polar medium. Ionic liquids are generally appreciated to be environmental-friendly or "green" alternatives to conventional organic solvents.

Accordingly, it is an objective of the claimed invention to develop solid cleaning compositions incorporating ionic liquids as a means for APE-replacement and a solidification mechanism.

A further object of the invention is to develop solid formulations at room temperature incorporating ionic liquids.

BRIEF SUMMARY OF THE INVENTION

In an embodiment, the present invention is a concentrated solid cleaning composition comprising: an effective amount of a cleaning agent to provide soil removal, wherein the cleaning agent comprises from about 1 wt-% to about 90 wt-% ionic liquid, and about 10 wt-% to about 99 wt-% of a polyethylene glycol hardening agent, and wherein the composition remains solid at room temperature.

In a further embodiment, the present invention is a concentrated solid hard surface cleaning composition comprising: from about 1 wt-% to about 50 wt-% of an ionic liquid, wherein the ionic liquid is a quaternized alkyl imidazoline; from about 30 wt-% and about 60 wt-% of a hardening agent; from about 0.1 wt-% and about 20 wt-% of a silicate; and from about 0.1 wt-% to about 50 wt-% of an agent selected from the group consisting of a surfactant, solvent, additional functional ingredient and combination thereof, wherein the composition remains solid at room temperature.

In an additional embodiment, method for removing soils from a surface are provided. The methods comprise: providing a solid concentrated cleaning composition; optionally diluting the concentrated solid cleaning composition with water of dilution to form a use solution, wherein the cleaning composition comprises from about 1 wt-% to about 50 wt-% of an ionic liquid and from about 30 wt-% and about 60 wt-% of a hardening agent, wherein the cleaning composition comprises less than about 0.5% by weight alkyl phenol ethoxylates and is a solid at room temperature; and contacting the surface in need of soil removal with the solid concentrated cleaning composition or the use solution.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

DETAILED DESCRIPTION OF THE PREFERRED EMBODIMENT

An advantage of the present invention is the replacement of APE in solid cleaning compositions to provide a more renewable product. In particular, ionic liquids are included in solid cleaning compositions and unexpectedly remain solid at room temperatures. It is an advantage of the present invention that more renewable cleaning compositions are provided without compromising the stability and/or solidification of the cleaning compositions.

The embodiments of this invention are not limited to particular solidification mechanisms, compositions employing the same and methods of using the solid compositions, which can vary and are understood by skilled artisans. It is further to be understood that all terminology used herein is for the purpose of describing particular embodiments only, and is not intended to be limiting in any manner or scope. For example, as used in this specification and the appended claims, the singular forms "a," "an" and "the" can include plural referents unless the content clearly indicates otherwise. Further, all units, prefixes, and symbols may be denoted in its SI accepted form. Numeric ranges recited within the specification are inclusive of the numbers defining the range and include each integer within the defined range.

So that the present invention may be more readily understood, certain terms are first defined. Unless defined otherwise, all technical and scientific terms used herein have the same meaning as commonly understood by one of ordinary skill in the art to which embodiments of the invention pertain. Many methods and materials similar, modified, or equivalent to those described herein can be used in the practice of the embodiments of the present invention without undue experimentation, the preferred materials and methods are described herein. In describing and claiming the embodiments of the present invention, the following terminology will be used in accordance with the definitions set out below.

The term "about," as used herein, refers to variation in the numerical quantity that can occur, for example, through typical measuring and liquid handling procedures used for making concentrates or use solutions in the real world; through inadvertent error in these procedures; through differences in the manufacture, source, or purity of the ingredients used to make the compositions or carry out the methods; and the like. The term "about" also encompasses amounts that differ due to different equilibrium conditions for a composition resulting from a particular initial mixture. Whether or not modified by the term "about", the claims include equivalents to the quantities.

The term "actives" or "percent actives" or "percent by weight actives" or "actives concentration" are used interchangeably herein and refers to the concentration of those ingredients involved in cleaning expressed as a percentage minus inert ingredients such as water or salts.

The term "alkyl" refers to a straight or branched chain monovalent hydrocarbon radical having a specified number of carbon atoms. Alkyl groups may be unsubstituted or substituted with substituents that do not interfere with the specified function of the composition and may be substituted once or twice with the same or different group. Substituents may include alkoxy, hydroxy, mercapto, amino, alkyl substituted amino, nitro, carboxy, carbonyl, carbonyloxy, cyano, methylsulfonylamino, or halogen, for example. Examples of "alkyl" include, but are not limited to, methyl, ethyl, n-propyl, isopropyl, n-butyl, s-butyl, t-butyl, n-pentyl, n-hexyl, 3-methylpentyl, and the like.

As used herein, the terms "alkyl phenol ethoxylate-free" or "NPE-free" refers to a composition, mixture, or ingredients that do not contain alkyl phenol ethoxylates or phenol-containing compounds or to which the same has not been added. Should alkyl phenol ethoxylates or -alkyl phenol ethoxylate containing compound be present through contamination of a composition, mixture, or ingredients, the amount of the same shall be less than 0.5 wt-%. In another embodiment, the amount of is less than 0.1 wt-% and in yet another embodiment, the amount is less than 0.01 wt-%.

The term "cleaning" means to perform or aid in soil removal, bleaching, microbial population reduction, rinsing, or combination thereof.

As used herein, the term "hard surface" includes showers, sinks, toilets, bathtubs, countertops, windows, mirrors, transportation vehicles, floors, and the like. These surfaces can be those typified as "hard surfaces" (such as walls, floors, bedpans).

As used herein, a "solid" cleaning composition refers to a cleaning composition in the form of a solid such as a powder, a particle, an agglomerate, a flake, a granule, a pellet, a tablet, a lozenge, a puck, a briquette, a brick, a solid block, a unit dose, or another solid form known to those of skill in the art. The term "solid" refers to the state of the composition under the expected conditions of storage and use of the solid composition. In general, it is expected that the composition will remain in solid form when exposed to temperatures of up to about 100° F. and greater than about 120° F. Beneficially, according to the invention the ionic liquids are incorporated into solid cleaning compositions which remain solid at room temperature despite the incorporation of ionic liquids which as salts remain liquids at elevated temperatures (e.g. about 100° C.). A cast, pressed, or extruded "solid" may take any form including a block. When referring to a cast, pressed, or extruded solid it is meant that the hardened composition will not flow perceptibly and will substantially retain its shape under moderate stress or pressure or mere gravity, as for example, the shape of a mold when removed from the mold, the shape of an article as formed upon extrusion from an extruder, and the like. The degree of hardness of the solid cast composition can range from that of a fused solid block, which is relatively dense and hard, for example, like concrete, to a consistency characterized as being malleable and sponge-like, similar to caulking material.

As used herein, the term "substantially free" refers to compositions completely lacking the component or having such a small amount of the component that the component does not affect the effectiveness of the composition. The component may be present as an impurity or as a contaminant and shall be less than 0.5 wt-%. In another embodiment, the amount of the component is less than 0.1 wt-% and in yet another embodiment, the amount of component is less than 0.01 wt-%.

The term "substantially similar cleaning performance" refers generally to achievement by a substitute cleaning product or substitute cleaning system of generally the same degree (or at least not a significantly lesser degree) of cleanliness or with generally the same expenditure (or at least not a significantly lesser expenditure) of effort, or both, when using the substitute cleaning product or substitute cleaning system rather than a alkyl phenol ethoxylate-containing cleaning to address a typical soiling condition on a typical substrate. This degree of cleanliness may, depending on the particular cleaning product and particular substrate, correspond to a general absence of visible soils, or to some lesser degree of cleanliness.

The term "weight percent," "wt-%," "percent by weight," "% by weight," and variations thereof, as used herein, refer to the concentration of a substance as the weight of that substance divided by the total weight of the composition and multiplied by 100. It is understood that, as used here, "percent," "%," and the like are intended to be synonymous with "weight percent," "wt-%," etc.

The methods, systems, and compositions of the present invention may comprise, consist essentially of, or consist of the component and ingredients of the present invention as well as other ingredients described herein. As used herein, "consisting essentially of" means that the methods, systems, and compositions may include additional steps, components or ingredients, but only if the additional steps, components or ingredients do not materially alter the basic and novel characteristics of the claimed methods, systems, and compositions. In particular, "consisting essentially of" refers to a composition including the listed ingredients and/or amounts of listed ingredients and does not include additional ingredients affecting the composition's ability to clean or affect the composition's ability to harden into a solid.

Solid Cleaning Compositions

The present invention relates to solid cleaning compositions. In particular, the cleaning composition is particularly suitable for use as a hard surface cleaning composition that does not include APEs. In one embodiment, the cleaning compositions of the present invention are substantially free of APEs (including NPEs), making the cleaning compositions more environmentally acceptable. APE-free refers to a composition, mixture, or ingredients to which APEs are not added. Should APEs be present through contamination of an APE-free composition, mixture, or ingredient, the level of APEs in the resulting composition is less than approximately 0.5 wt-%, less than approximately 0.1 wt-%, and often less than approximately 0.01 wt-%.

In one embodiment, the solid cleaning composition includes an ionic liquid and a hardening agent. In another embodiment, the solid cleaning compositions may further include a silicate. In another embodiment, the cleaning compositions may still further include a surfactant, co-surfactant and/or solvent. In a further embodiment, the solid cleaning compositions may also include additional functional ingredients.

Exemplary solid cleaning compositions include between about 1 wt-% and about 90 wt-% ionic liquid component, between about 10 wt-% and about 99 wt-% hardening agent, between about 0 wt-% and about 40 wt-% silicate, between about 0 wt-% and about 50% surfactant, between about 0 wt-% and about 25 wt-% solvent and between about 0 wt-% and about 20 wt-% additional functional ingredient. More preferred solid cleaning compositions include between about 1 wt-% and about 50 wt-% ionic liquid component, between about 20 wt-% and about 80 wt-% hardening agent, optionally between about 0.1 wt-% and about 20 wt-% silicate, optionally between about 1 wt-% and about 40% surfactant, optionally between about 0 wt-% and about 20 wt-% solvent and optionally between about 0.01 wt-% and about 20 wt-% additional functional ingredient. More particularly, the solid cleaning compositions include between about 10 wt-% and about 30 wt-% ionic liquid component, between about 30 wt-% and about 60 wt-% hardening agent, optionally between about 1 wt-% and about 20 wt-% silicate, optionally between about 10 wt-% and about 40% surfactant, optionally between about 0 wt-% and about 10 wt-% solvent, and optionally between about 0.1 wt-% and about 10 wt-% additional functional ingredient.

Exemplary solid cleaning compositions are shown in Table 1.

TABLE 1

| Component | Preferred Ranges (Wt-%) | | |
|---|---|---|---|
| Ionic Liquids | 1-90 | 1-50 | 10-30 |
| Hardening Agent | 10-99 | 20-80 | 30-60 |
| Silicate | 0-40 | 0.1-20 | 1-20 |
| Surfactant | 0-50 | 1-40 | 10-40 |
| Solvent | 0-25 | 0-20 | 0-10 |
| Additional Functional Ingredients | 0-20 | 0.01-20 | 0.1-10 |

Ionic Liquids

In an embodiment of the invention an ionic liquid is employed in the solid cleaning composition to replace traditional organic solvents and/or surfactants. Ionic liquids may include surfactants and/or solvents. Exemplary ionic liquids are bio-based, which may have bio-based content of at least 10%, preferably at least 15%, more preferably at least 50%, and still more preferably at least about 85%. As one of skill in the art shall ascertain based upon the disclosure of the present invention, the ionic liquids containing less than 100% bio-based content also include synthetic content. In some embodiments the ionic liquids are manufactured using renewable carbon and are thus an alternative to synthetic oil based surfactants.

Traditionally, ionic liquids act as non-flammable, low VOC solvents within cleaning compositions. Accordingly, the bio-based, non-APE/NPE surfactant ionic liquids provide improved cleaning efficacy. In one embodiment, the ionic liquid cleaning compositions are substantially free of alkyl phenol ethoxylates (APEs) such as nonyl phenol ethoxylates (NPEs). Thus, the ionic liquid cleaning compositions provide a green, readily biodegradable replacement for conventional detergent surfactants.

Examples of suitable ionic liquids include liquid quaternary compounds. Particularly suitable liquid quaternary compounds include quaternized alkyl imidazolines. Preferred examples include Isostearyl Ethylimidazolinium Ethosulfate, Oleyl Ethylimidazolinium Ethosulfate or combinations of the same, which are commercially available as Cola®Solv IES and Cola®Solv OES, respectively, available from Colonial Chemical, South Pittsburg, Tenn. In a preferred aspect of the invention one ionic liquid is employed for the solid cleaning composition.

Additional description of conventional ionic liquids is provided in, for example, U.S. Pat. Nos. 5,827,602 and 6,048,388; and PCT publications: WO 02/26701, WO 03/074494, WO 03/022812, and WO 04/016570, which are incorporated by reference herein in their entirety.

Hardening Agents

In an embodiment of the invention hardening agents are employed in the solid cleaning compositions. Hardening agents may often be referred to as solidification agents as they are responsible for maintaining the overall composition (including solids and liquids) in a solid form. In an embodiment the hardening agent may be a polyethylene glycol (PEG), EO/PO block copolymer, amides or the like as are commonly employed for solidification agents. In a preferred embodiment the hardening agent comprises or consists of polyethylene glycol (PEG). Various solid polyethylene glycols suitable for use according to the invention are marketed under the trademarks Pluriol™ (BASF) or Carbowax™ (Dow Chemical). Beneficially, polyethylene glycols at lower molecular weights, such as PEG 4000, are biodegradable allowing a formulation to be environmentally safe and friendly.

The molecular weight of the polyethylene glycol may range from less than about 8,000. In a still further preferred embodiment the hardening agent is polyethylene glycol having a molecular weight of from about 4,000 (hereinafter PEG 4000) to about 8,000 (hereinafter PEG 8000), which are superior to other polyethylene glycols. In a preferred embodiment, a biodegradable polyethylene glycol is employed. An example of a preferred embodiment employs the PEG 4000, which forms solid block compositions having a good consistency. By "good consistency" it is meant that the solid retained a block shape without being overly brittle or liquefying after solidification. That is, the solid containing PEG 4000 did not crumble or break nor was it too fragile to handle or for shipment as shown in the Examples.

The amount of hardening agent included in the cleaning composition will vary according to the type of cleaning composition being prepared, the ingredients of the composition, the intended use of the composition, temperatures, physical size of the solid compositions, the concentration of the other ingredients employed in the cleaning compositions, and other like factors. The amount of the hardening agent is effective to combine with the ionic liquid and other optional ingredients of the composition to form a homogeneous mixture under continuous mixing conditions.

Silicates

In an embodiment of the invention silicates may be employed in the solid cleaning compositions. As used herein silicates are understood to include both precipitated silica (i.e. silicon dioxide) and silicates (i.e. $SiO_4^{4-}$). Silicates are known to be insoluble materials and may include a variety of silicate anions with a charge balanced by various cations. Silicas and silicates are employed for their high absorption capacity for liquids and good flowability. In an embodiment, silicas or silicates are capable of converting a liquid into a free flowing powder.

Silicas or silicates of varying surface areas and particle sizes may be employed. Silica or organosilica inorganic particles with average particle size of about 0.001 to about 10 micrometers are preferred in one embodiment of the invention. In a preferred aspect, an alkali metal precipitated silica or silicate is included in the solid cleaning composition.

Preferably, the precipitated silica or silicate is an aluminum and/or calcium silica or silicate.

Various silicates suitable for use according to the invention are marketed, including under the tradename Sipernat® (Evonik Industries), including for example Sipernat® 22.

In other embodiments, the solid cleaning compositions of the present invention can include a similar agent or combination of agents to the silicates that provide a requisite degree of solidification.

Surfactants

In an embodiment of the invention surfactants and/or co-surfactants may be employed in the solid cleaning compositions. In the event the cleaning composition also includes a surfactant or co-surfactant, the co-surfactant is employed to help increase the amount of soil removed from a surface cleaned with the composition. The surfactants are included in an amount such that the ratio of ionic liquid to surfactant is about 10:1 to 1:10, preferably from about 5:1 to 1:5, more preferably about 1:1.

Various suitable surfactants may be employed as described herein, including those surfactants described and incorporated by reference in their entirety from, for example, U.S. Pat. No. 7,153,820. Preferably if an additional surfactant is used with the ionic liquids the surfactant is an NPE alternative surfactant. In certain preferred embodiments the surfactant is a nonionic surfactant, namely an ethoxylated alcohol. In additional preferred embodiments the surfactant is an anionic surfactant, namely an alkyl aryl sulfonate.

Nonionic Surfactants

The cleaning composition preferably contains a nonionic surfactant component that includes a detersive amount of nonionic surfactant or a mixture of nonionic surfactants. Nonionic surfactants can be included in the cleaning composition to enhance grease removal properties. Although the surfactant component can include a nonionic surfactant component, it should be understood that the nonionic surfactant component can be excluded from the solid cleaning composition.

Nonionic surfactants that can be used in the composition include alcohol alkoxylates. An suitable alcohol alkoxylate include linear alcohol ethoxylates such as Tomadol™ 1-5 which is a surfactant containing an alkyl group having 11 carbon atoms and 5 moles of ethylene oxide. Additional alcohol alkoxylates include alkylphenol ethoxylates, branched alcohol ethoxylates, secondary alcohol ethoxylates (e.g., Tergitol 15-S-7 from Dow Chemical), castor oil ethoxylates, alkylamine ethoxylates, tallow amine ethoxylates, fatty acid ethoxylates, sorbital oleate ethoxylates, end-capped ethoxylates, or mixtures thereof.

Additional nonionic surfactants include amides such as fatty alkanolamides, alkyldiethanolamides, coconut diethanolamide, lauric diethanolamide, polyethylene glycol cocoamide (e.g., PEG-6 cocoamide), oleic diethanolamide, or mixtures thereof. Additional suitable nonionic surfactants include polyalkoxylated aliphatic base, polyalkoxylated amide, glycol esters, glycerol esters, amine oxides, phosphate esters, alcohol phosphate, fatty triglycerides, fatty triglyceride esters, alkyl ether phosphate, alkyl esters, alkyl phenol ethoxylate phosphate esters, alkyl polysaccharides, block copolymers, alkyl polyglucosides, or mixtures thereof. Still further nonionic surfactants include polyalkylene oxide surfactants (also known as polyoxyalkylene surfactants or polyalkylene glycol surfactants). Suitable polyalkylene oxide surfactants include polyoxypropylene surfactants and polyoxyethylene glycol surfactants. Suitable surfactants of this type are synthetic organic polyoxypropylene (PO)-polyoxyethylene (EO) block copolymers. These surfactants include a di-block polymer comprising an EO block and a PO block, a center block of polyoxypropylene units (PO), and having blocks of polyoxyethylene grafted onto the polyoxypropylene unit or a center block of EO with attached PO blocks. Further, this surfactant can have further blocks of either polyoxyethylene or polyoxypropylene in the molecules. A suitable average molecular weight range of useful surfactants can be about 1,000 to about 40,000 and the weight percent content of ethylene oxide can be about 10-80 wt-%.

Anionic Surfactants

The cleaning composition can contain an anionic surfactant component that includes a detersive amount of an anionic surfactant or a mixture of anionic surfactants. Anionic surfactants are desirable in cleaning compositions because of their wetting and detersive properties. The anionic surfactants that can be used according to the invention include any anionic surfactant available in the cleaning industry. Suitable groups of anionic surfactants include sulfonates and sulfates. Suitable surfactants that can be provided in the anionic surfactant component include alkyl aryl sulfonates, secondary alkane sulfonates, alkyl methyl ester sulfonates, alpha olefin sulfonates, alkyl ether sulfates, alkyl sulfates, and alcohol sulfates.

Suitable alkyl aryl sulfonates that can be used in the cleaning composition can have an alkyl group that contains 6 to 24 carbon atoms and the aryl group can be at least one of benzene, toluene, and xylene. A suitable alkyl aryl sulfonate includes linear alkyl benzene sulfonate. A suitable linear alkyl benzene sulfonate includes linear dodecyl benzyl sulfonate that can be provided as an acid that is neutralized to form the sulfonate. Additional suitable alkyl aryl sulfonates include xylene sulfonate and cumene sulfonate.

Suitable alkane sulfonates that can be used in the cleaning composition can have an alkane group having 6 to 24 carbon atoms. Suitable alkane sulfonates that can be used include secondary alkane sulfonates. A suitable secondary alkane sulfonate includes sodium $C_{14}$-$C_{17}$ secondary alkyl sulfonate commercially available as Hostapur SAS from Clariant. Suitable alkyl methyl ester sulfonates that can be used in the cleaning composition include those having an alkyl group containing 6 to 24 carbon atoms. Suitable alpha olefin sulfonates that can be used in the cleaning composition include those having alpha olefin groups containing 6 to 24 carbon atoms. Suitable alkyl ether sulfates that can be used in the cleaning composition include those having between about 1 and about 10 repeating alkoxy groups, between about 1 and about 5 repeating alkoxy groups. In general, the alkoxy group will contain between about 2 and about 4 carbon atoms. A suitable alkoxy group is ethoxy. A suitable alkyl ether sulfate is sodium lauryl ether sulfate and is available under the name Steol CS-460. Suitable alkyl sulfates that can be used in the cleaning composition include those having an alkyl group containing 6 to 24 carbon atoms. Suitable alkyl sulfates include, but are not limited to, sodium lauryl sulfate and sodium lauryl/myristyl sulfate. Suitable alcohol sulfates that can be used in the cleaning composition include those having an alcohol group containing about 6 to about 24 carbon atoms.

The anionic surfactant can be neutralized with an alkaline metal salt, an amine, or a mixture thereof. Suitable alkaline metal salts include sodium, potassium, and magnesium. Suitable amines include monoethanolamine, triethanolamine, and monoisopropanolamine. If a mixture of salts is used, a suitable mixture of alkaline metal salt can be sodium and magnesium, and the molar ratio of sodium to magnesium can be between about 3:1 and about 1:1.

Amphoteric Surfactants

Amphoteric surfactants can also be used to provide desired detersive properties.

Suitable amphoteric surfactants that can be used include, but are not limited to: sulfosuccinates, imidazolines, and propionates. Suitable amphoteric surfactants include, but are not limited to: sultaines, amphopropionates, amphodipropionates, aminopropionates, aminodipropionates, amphoacetates, amphodiacetates, and amphohydroxypropylsulfonates.

Cationic Surfactants

The cleaning composition can contain a cationic surfactant component that includes a detersive amount of cationic surfactant or a mixture of cationic surfactants. The cationic surfactant can be used to provide sanitizing properties. Cationic surfactants that can be used in the cleaning composition include, but are not limited to: amines such as primary, secondary and tertiary monoamines with $C_{1-8}$ alkyl or alkenyl chains, ethoxylated alkylamines, alkoxylates of ethylenediamine, imidazoles such as a 1-(2-hydroxyethyl)-2-imidazoline, a 2-alkyl-1-(2-hydroxyethyl)-2-imidazoline, and the like; and quaternary ammonium salts, as for example, alkylquaternary ammonium chloride surfactants such as n-alkyl ($C_{12}$-$C_{18}$)dimethylbenzyl ammonium chloride, n-tetradecyldimethylbenzylammonium chloride monohydrate, and a naphthylene-substituted quaternary ammonium chloride such as dimethyl-1-naphthylmethylammonium chloride.

Zwitterionic and Amphoteric Surfactants

The cleaning composition can contain a zwitterionic and/or amphoteric surfactant component that includes a detersive amount of these surfactants or a mixture thereof. Exemplary surfactants include beta-N-alkylaminopropionic acids, n-alkyl-beta-iminodipropionic acids, imidazoline carboxylates, n-alkyl-betaines, amine oxides, sulfobetaines and sultaines.

Solvents

In an embodiment of the invention solvents may be employed in the solid cleaning compositions. A solvent is often times useful in cleaning compositions to enhance soil removal properties. The cleaning compositions of the invention may include a solvent to adjust the viscosity of the final composition. The intended final use of the composition may determine whether or not a solvent is included in the cleaning composition. If a solvent is included in the cleaning composition, it is usually a low cost solvent such as isopropyl alcohol. A solvent may or may not be included to improve soil removal, handleability or ease of use of the compositions of the invention.

Suitable solvents useful in removing hydrophobic soils include, but are not limited to: oxygenated solvents such as lower alkanols, lower alkyl ethers, glycols, aryl glycol ethers and lower alkyl glycol ethers. Examples of other solvents include, but are not limited to: methanol, ethanol, propanol, isopropanol and butanol, isobutanol, ethylene glycol, diethylene glycol, triethylene glycol, propylene glycol, dipropylene glycol, mixed ethylene-propylene glycol ethers, ethylene glycol phenyl ether, and propylene glycol phenyl ether. Substantially water soluble glycol ether solvents include, not are not limited to: propylene glycol methyl ether, propylene glycol propyl ether, dipropylene glycol methyl ether, tripropylene glycol methyl ether, ethylene glycol butyl ether, diethylene glycol methyl ether, diethylene glycol butyl ether, ethylene glycol dimethyl ether, ethylene glycol propyl ether, diethylene glycol ethyl ether, triethylene glycol methyl ether, triethylene glycol ethyl ether, triethylene glycol butyl ether and the like.

Additional Functional Ingredients

In an embodiment of the invention additional functional ingredients may be employed in the solid cleaning compositions. In some embodiments, the cleaning compositions have few or no additional functional ingredients disposed therein. The functional ingredients provide desired properties and functionalities to the cleaning composition. For the purpose of this application, the term "functional ingredients" include an ingredients that when dispersed or dissolved in a use and/or concentrate solution, such as an aqueous solution, provides a beneficial property in a particular use. Exemplary functional ingredients include conventional detergent adjuvants, such as soil-digesting components, surfactants, alkaline source, chelating or sequestering agent, a threshold agent or system, disinfectants, detergent fillers, sanitizers, acidulants, complexing agents, biocides, corrosion inhibitors, antiredeposition agents, foam inhibitors, dyes, bleaching agents, bleach activator, optical brighteners, enzymes, enzyme stabilizing systems, thickening or gelling agents, wetting agents, dispersants, stabilizing agents, buffering agent, aesthetic enhancing agent (i.e., dye, perfume), and other like additives as described, for example, in U.S. Pat. Nos. 7,153,820 and 7,341,983, which are incorporated herein by reference in their entirety.

The various, optional additional materials can be pre-formulated with the present composition or added to the system simultaneously, or even after, the addition of the present cleaning composition. The cleaning composition can also contain any number of other constituents as necessitated by the application, which are known and which can facilitate the activity of the present compositions. Some particular examples of functional materials are discussed in more detail below, but it should be understood by those of skill in the art and others that the particular materials discussed are given by way of example only, and that a broad variety of other functional materials may be used. For example, many of the functional materials discussed below relate to materials used in cleaning and/or destaining applications, but it should be understood that other embodiments may include functional materials for use in other applications.

Bleaching Agents

The cleaning composition may also include bleaching agents for lightening or whitening a substrate. Examples of suitable bleaching agents include bleaching compounds capable of liberating an active halogen species, such as $Cl_2$, $Br_2$, —OCl— and/or —OBr—, under conditions typically encountered during the cleansing process. Suitable bleaching agents for use in the present cleaning compositions include, for example, chlorine-containing compounds such as a chlorine, a hypochlorite, and chloramine. Exemplary halogen-releasing compounds include the alkali metal dichloroisocyanurates, chlorinated trisodium phosphate, the alkali metal hypochlorites, monochloramine and dichloramine, and the like. Encapsulated chlorine sources may also be used to enhance the stability of the chlorine source in the composition (see, for example, U.S. Pat. Nos. 4,618,914 and 4,830,773, the disclosures of which are incorporated by reference in their entirety herein for all purposes). A bleaching agent may also be a peroxygen or active oxygen source such as hydrogen peroxide, perborates, sodium carbonate peroxyhydrate, phosphate peroxyhydrates, potassium permonosulfate, and sodium perborate mono and tetrahydrate, with and without activators such as tetraacetylethylene diamine, and the like. The composition can include an effective amount of a bleaching agent.

Detergent Fillers

The cleaning composition can include an effective amount of detergent fillers, which does not perform as a cleaning agent per se, but cooperates with the cleaning agent to enhance the overall cleaning capacity of the composition. Examples of detergent fillers suitable for use in the present cleaning compositions include sodium sulfate, sodium chloride, starch, sugars, $C_1$-$C_{10}$ alkylene glycols such as propylene glycol, and the like.

Defoaming Agents

The cleaning composition can include a defoaming agent to reduce the stability of foam and reduce foaming. Examples of defoaming agents that can be used in the composition includes ethylene oxide/propylene oxide block copolymers such as those available under the name Pluronic N3, silicone compounds such as silica dispersed in polydimethylsiloxane, polydimethylsiloxane, and functionalized polydimethylsiloxane such as those available under the name Abil B9952, fatty amides, hydrocarbon waxes, fatty acids, fatty esters, fatty alcohols, fatty acid soaps, ethoxylates, mineral oils, polyethylene glycol esters, alkyl phosphate esters such as monostearyl phosphate, and the like. A discussion of defoaming agents may be found, for example, in U.S. Pat. Nos. 3,048,548, 3,334,147 and 3,442,242, the disclosures of which are incorporated by reference in their entirety herein for all purposes.

Antiredeposition Agents

The cleaning composition can include an anti-redeposition agent for facilitating sustained suspension of soils in a cleaning solution and preventing the removed soils from being redeposited onto the substrate being cleaned. Examples of suitable anti-redeposition agents include fatty acid amides, fluorocarbon surfactants, complex phosphate esters, styrene maleic anhydride copolymers, and cellulosic derivatives such as hydroxyethyl cellulose, hydroxypropyl cellulose, and the like.

Stabilizing Agents

Stabilizing agents that can be used in the cleaning composition include, but are not limited to: primary aliphatic amines, sulfosuccinates, borate, calcium ions, sodium citrate, citric acid, sodium formate, glycerine, malonic acid, organic diacids, polyols, propylene glycol, and mixtures thereof. The concentrate need not include a stabilizing agent, but when the concentrate includes a stabilizing agent, it can be included in an amount that provides the desired level of stability of the concentrate.

Dispersants

Dispersants that can be used in the cleaning composition include maleic acid/olefin copolymers, polyacrylic acid, and its copolymers, and mixtures thereof. The concentrate need not include a dispersant, but when a dispersant is included it can be included in an amount that provides the desired dispersant properties.

Sequestering Agents

The cleaning composition may include a sequestering agent such as an amino carboxylic acid, a condensed phosphate, a phosphonate, a polyacrylate, and the like. In general, a sequestering agent is a molecule capable of coordinating (i.e. binding) the metal ions commonly found in natural water to prevent the metal ions from interfering with the action of the other detersive ingredients of a cleaning composition. A class of sequestrant suitable for use with the invention includes citrates and in an embodiment, sodium citrate dihydrate. A further class of sequestering agents includes polyacrylates and aminocarboxylic acids, for example, n-hydroxyethyliminodiacetic acid, nitrilotriacetic acid (NTA), ethylenediaminetetraacetic acid (EDTA), N-hydroxyethylethylenediaminetriacetic acid (HEDTA), diethylenetriaminepentaacetic acid (DTPA), and the like. The invention further contemplates an embodiment that is a phosphate or phosphonate free composition.

Further discussion of chelating agents/sequestrants is provided by Kirk-Othmer, Encyclopedia of Chemical Technology, Third Edition, volume 5, pages 339-366 and volume 23, pages 319-320, the disclosure of which is incorporated by reference herein.

Dyes and Fragrances

Various dyes, odorants including perfumes, and other aesthetic enhancing agents may also be included in the cleaning composition. Dyes may be included to alter the appearance of the composition, as for example, any of a variety of FD&C dyes, D&C dyes, and the like. Additional suitable dyes include Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keystone Aniline and Chemical), Metanil Yellow (Keystone Aniline and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (BASF), Pylakor Acid Bright Red (Pylam), and the like. Fragrances or perfumes that may be included in the compositions include, for example, terpenoids such as citronellol, aldehydes such as amyl cinnamaldehyde, a jasmine such as C1S-jasmine or jasmal, vanillin, and the like.

Methods of Formulating Solid Cleaning Compositions

The present invention relates to solid cleaning compositions and methods of using the cleaning compositions for cleaning and removing soils from a surface. In particular, the cleaning composition is particularly suitable for use as a hard surface cleaning composition. While an understanding of the mechanism is not necessary to practice the present invention and while the present invention is not limited to any particular mechanism of action, it is contemplated that, in some embodiments, the inclusion of the PEG 4000 with the ionic liquids in the solid cleaning compositions provides unexpected solidification.

Various solidification mechanisms are known by those of skill in the art, including for example the methods disclosed in U.S. Pat. Nos. 7,094,746, 7,153,820, 7,863,237 and 8,063,010, and U.S. patent application Ser. Nos. 12/895,181, now published as U.S. Pub. No. 2012/0083437 the disclosures of which are incorporated herein by reference in their entirety.

The methods of making the solid cleaning compositions may include the mixing of the composition components in a mixing system, which is preferably sufficient to provide dispersion of the ionic liquids and the hardening agents. Heat may be applied from an external source to facilitate processing of the mixture. High shear mixing may be employed to form a substantially homogenous liquid or semi-solid mixture. The heated mixture can be formed into a composition through casting or extruding to form a variety of desired shapes and/or sizes. The solid composition precursor can be provided as a melt that is allowed to cool to room temperature and solidify as a result of cooling. A preferred solidification mechanism for use according to the invention is PEG-based casting.

Beneficially, the solidification mechanisms according to the invention employ ionic liquids and a hardening agent, along with additional optional ingredients. However, other hardening agents commonly used in solid cleaning compositions are not required in the compositions of the invention. These include, for example, urea/carbamide, or starches that have been made water-soluble through an acid or alkaline treatment process.

A variety of solid cleaning compositions may be produced according to the present invention. In an embodiment the invention, the solid cleaning compositions are provided as a concentrate such that the cleaning composition is substantially free of any added water or the concentrate may contain a nominal amount of water. The concentrate can be formulated without any water or can be provided with a relatively small amount of water in order to reduce the expense of transporting the concentrate. For example, the composition concentrate can be provided as a capsule or pellet of compressed powder, a solid, or loose powder, either contained by a water soluble material or not. In the case of providing the capsule or pellet of the composition in a material, the capsule or pellet can be introduced into a volume of water, and if present the water soluble material can solubilize, degrade, or disperse to allow contact of the composition concentrate with the water. For the purposes of this disclosure, the terms "capsule" and "pellet" are used for exemplary purposes and are not intended to limit the delivery mode of the invention to a particular shape.

In yet another embodiment, the concentrate composition can be provided in a solid form that resists crumbling or other degradation until placed into a container. Such container may either be filled with water before placing the composition concentrate into the container, or it may be filled with water after the composition concentrate is placed into the container. In either case, the solid concentrate composition dissolves, solubilizes, or otherwise disintegrates upon contact with water. In a particular embodiment, the solid concentrate composition dissolves rapidly thereby allowing the concentrate composition to become a use composition and further allowing the end user to apply the use composition to a surface in need of cleaning. When the cleaning composition is provided as a solid, the compositions provided herein may be altered in a manner to solidify the cleaning composition by any means known in the art. For example, the amount of water may be reduced or additional ingredients may be added to the cleaning composition, such as a solidification agent.

In another embodiment, the solid composition may be cast or extruded into temporary molds from which the solidified compositions may be removed and transferred for packaging. The compositions may also be cast or extruded into a variety of shapes and sizes. The compositions may also be cast or extruded directly into a packaging receptacle. Extruded material may also be cut to a desired size and packaged, or stored and packaged at a later time. The packaging receptacle or container may be rigid or flexible, and composed of any material suitable for containing the compositions produced according to the invention, as for example, glass, steel, plastic, cardboard, cardboard composites, paper, and the like. In an embodiment a receptacle is a container comprised of a polyolefin such as high density polyethylene or low density polyethylene. The packaging used to contain the compositions may be manufactured from a material which is biodegradable and/or water-soluble during use. Such packaging is useful for providing controlled release and dispensing of the contained cleaning composition. Biodegradable materials useful for packaging the compositions of the invention include, for example, water-soluble polymeric films comprising polyvinyl alcohol, as disclosed for example in U.S. Pat. Nos. 4,474,976, 4,692,494, 4,608,187, 4,416,793, 4,348,293, 4,289,815, and 3,695,989, the disclosures of which are incorporated by reference herein in their entirety.

In another embodiment, the solid concentrate composition can be diluted through dispensing equipment whereby water is sprayed at the solid block forming the use solution. Various spray-type dispensers are disclosed in U.S. Pat. Nos. 4,826,661, 4,690,305, 4,687,121, and 4,426,362, the disclosures of which are incorporated by reference herein in their entirety. The water flow is delivered at a relatively constant rate using mechanical, electrical, or hydraulic controls and the like. The solid concentrate composition can also be diluted through dispensing equipment whereby water flows around the solid block, creating a use solution as the solid concentrate dissolves. The solid concentrate composition can also be diluted through pellet, tablet, powder and paste dispensers, and the like.

The water used to dilute the concentrate compositions of the invention (water of dilution) can be available at the locale or site of dilution. The water of dilution may contain varying levels of hardness depending upon the locale. Service waters available from various municipalities have varying levels of hardness. It is desirable to provide a concentrate that can handle the hardness levels found in the service water of various municipalities. The water of dilution that is used to dilute the concentrate can be characterized as hard water when it includes at least 1 grain hardness. It is expected that the water of dilution can include at least 5 grains hardness, at least 10 grains hardness, or at least 20 grains hardness.

It is expected that the concentrate will be diluted with the water of dilution in order to provide a use solution having a desired level of detersive properties. If the use solution is required to remove tough or heavy soils, it is expected that the concentrate can be diluted with the water of dilution at a weight ratio of at least 1:1 and up to 1:16. If a light duty cleaning use solution is desired, it is expected that the concentrate can be diluted at a weight ratio of concentrate to water of dilution of up to about 1:256.

Methods of Using the Cleaning Compositions

In an aspect of the invention, the solid cleaning compositions incorporating an ionic liquid provide suitable soil removal capabilities while remaining substantially free of APE. APE's are often useful in soil removal, namely degreasing, compositions to enhance soil removal properties. The solid ionic liquid cleaning compositions of the invention are suitable for uses with a variety of soils.

The methods of using the solid cleaning compositions may include the step of diluting a concentrated cleaning composition. As set forth above, the dilution step may include the use of a variety of waters for dilution. As one skilled in the art will appreciated, the amount of dilution water employed will be determined by the desired ratio of cleaning composition to water (i.e. dilution rate) to obtain a dispensing concentration suitable for a particular surface in need of cleaning. In many embodiments, the dispensing rate of the cleaning concentration will range from about 1 oz./gallon to about 64 oz./gallon, preferably from about 4 oz./gallon to about 16 oz./gallon.

Alternative methods of using the solid cleaning composition include the direct application of the solid cleaning composition to a surface in need of soil removal. For example, a solid or semi-solid composition at room temperature may be applied to a fabric or laundry surface. Thereafter water for dilution may be employed.

According to the methods of the invention, the cleaning composition is applied to a surface in need of cleaning. Compositions of the invention may be useful to clean a variety of surfaces. Exemplary hard-surfaces suitable for cleaning with the solid cleaning compositions of the invention include ceramics, ceramic tile, grout, granite, concrete, mirrors, enameled surfaces, metals including aluminum, brass, stainless steel and the like.

The ionic liquid cleaning compositions can be used in various industries, including, but not limited to: manual and automatic warewashing, food and beverage, vehicle care, and quick service restaurants. In particular, the cleaning compositions can be used in hard-surface cleaning applications, including, for example: bathroom surfaces, dishwashing equipment, food and beverage equipment, vehicles and tabletops. As one skilled in the art shall ascertain based on the disclosure of the invention, the ionic liquid compositions are useful to formulate hard surface cleaners, oven cleaners, hand soaps, automotive detergents, warewashing detergents whether automatic or manual, and the like.

ments of the invention to adapt it to various usages and conditions. Thus, various modifications of the embodiments of the invention, in addition to those shown and described herein, will be apparent to those skilled in the art from the foregoing description. Such modifications are also intended to fall within the scope of the appended claims.

Various materials used in the following Examples are provided herein:

ColaSolv® IES: an ionic liquid, Isostearyl Ethylimidazolinium Ethosulfate, available from Colonial Chemical, Inc., South Pittsburg, Tn.

ColaSolv® OES: an ionic liquid, Oleyl Ethylimidazolinium Ethosulfate, available from Colonial Chemical, Inc., South Pittsburg, Tn.

Sipemat® 22: aluminum/calcium silicates, available from Evonik Industries.

Tomadol® 25-7: alcohol ethoxylate, available from Air Products and Chemicals, Inc., Allentown, Pa.

Downaol® DPnB: a hydrophobic glycol ether with surface tension-lowering ability and coalescing properties, available from the Dow Chemical Company.

Additional materials commercially-available from multiple sources include: LAS Flake and PEG 4000.

Example 1

Various solid cleaning compositions according to the invention were formulated and evaluated to determine the level of acceptable product hardness. Evaluated formulations are shown in Table 2.

TABLE 2

| | 1 | 2 | 3 | 4 | 5 | 6 | 7 | 8 | 9 | 10 |
|---|---|---|---|---|---|---|---|---|---|---|
| Ionic Liquid ColaSolv ® IES | 10-30% | 10-30% | 30-40% | | 30-40% | | 30-40% | | 10-30% | |
| Ionic Liquid ColaSolv ® OES | | | | 30-40% | | 10-30% | | 30-40% | | 10-30% |
| Hardening Agent (Melted) (>40 wt-%) | Yes | Yes | No | No | 40% | 40% | No | No | Yes | Yes |
| Silicate (1-20 wt-%) | Yes | Yes | | | | | Yes | Yes | | |
| Surfactant (10-40 wt-%) | Yes | | Yes | Yes | Yes | Yes | Yes | Yes | Yes | Yes |
| Co-Surfactant | | 10-20% | | | | | | | | |
| Solvent | | 1-10% | | | | | | | | |

All publications and patent applications in this specification are indicative of the level of ordinary skill in the art to which this invention pertains. All publications and patent applications are herein incorporated by reference to the same extent as if each individual publication or patent application was specifically and individually indicated as incorporated by reference.

EXAMPLES

Embodiments of the present invention are further defined in the following non-limiting Examples. It should be understood that these Examples, while indicating certain embodiments of the invention, are given by way of illustration only. From the above discussion and these Examples, one skilled in the art can ascertain the essential characteristics of this invention, and without departing from the spirit and scope thereof, can make various changes and modifications of the embodi- The compositions shown in Table 2 were initially observed to determine whether formulas were able to be successfully cast. Formulas 1 and 2 were cast and each demonstrated final compositions observed to be sufficiently hard. For each composition the hardening agent, PEG 4000, was melted before it was mixed into the system. Formula 2 further included a co-surfactant and a small amount of solvent which did not disrupt the solidification of the ionic fluid composition.

Formulas 3 and 4 did not sufficiently harden into a cast solid. After cooling to room temperature, the formulations were placed into a freezer and thereafter returned to a semi-soft solid. Without being limited to a particular theory of the invention, the increased amount of ionic liquid and decreased amount of hardening agent employed in the compositions provided a less solid composition. Formulas 5-10 were all cast solids that demonstrate a soft (i.e. pasty) solid.

Example 2

The solid cleaning compositions evaluated in Example 1 were further evaluated using a penetrometer to better quantify the solidification of the formations. Solid cleaning compositions were allowed to come to room temperature either by waiting 24 hours before testing or by cooling in a beaker in a 70° F. water bath for 20 minutes. The hardness of each formulation was analyzed according to the depth that a penetrometer needle sinks into a sample under standard conditions to give a measurement of product hardness. A total of 3 penetrations were obtained from each sample using a different area on the sample and calculating the average depth measurement.

The penetrometer readings are shown in Table 3.

TABLE 3

| Formula | Penetrometer Reading | Pop Out (Yes/No) |
|---|---|---|
| 1 | 10 | Yes |
| 2 | 10 | Yes |
| 3 | >80 | No |
| 4 | >80 | No |
| 5 | >80 | No |
| 6 | >80 | No |
| 7 | >80 | No |
| 8 | >80 | No |
| 9 | >80 | No |
| 10 | >80 | No |

The penetrometer readings <80 indicate a solidified cleaning composition suitable according to the invention. In addition, samples where the solid pops out of the casting container are preferred. As shown in Table 3, formulas 1 and 2 had sufficiently hardened compositions that popped out of the casting container.

The inventions being thus described, it will be obvious that the same may be varied in many ways. Such variations are not to be regarded as a departure from the spirit and scope of the inventions and all such modifications are intended to be included within the scope of the following claims.

What is claimed is:

1. A concentrated solid hard surface cleaning composition comprising:

(a) from about 1 wt-% to about 50 wt-% of an ionic liquid, wherein the ionic liquid is a quaternized alkyl imidazoline selected from the group consisting of isostearyl ethylimidazolinium ethosulfate, oleyl ethylimidazolinium ethosulfate and combinations thereof;

(b) from about 30 wt-% to about 60 wt-% of a hardening agent;

(c) from about 0.1 wt-% to about 20 wt-% of a silicate; and (d) from about 0.1 wt-% to about 50 wt-% of an agent selected from the group consisting of a surfactant, solvent, additional functional ingredient and combination thereof, wherein the composition remains solid at room temperature.

2. The cleaning composition of claim 1, wherein the ionic liquid is isostearyl ethylimidazolinium ethosulfate.

3. The cleaning composition of claim 1, wherein the hardening agent is a polyethylene glycol having a molecular weight from about 2000 to about 8000.

4. The cleaning composition of claim 1, wherein the ionic liquid constitutes between about 10% and about 30% by weight of the cleaning composition.

5. The cleaning composition of claim 4, wherein the surfactant is an ethoxylated alcohol or an alkyl aryl sulfonate.

6. The cleaning composition of claim 1, wherein the cleaning composition comprises less than about 0.1 wt-% by weight alkyl phenol ethoxylates.

7. A concentrated solid hard surface cleaning composition comprising:

(a) from 10 wt-% to about 50 wt-% of an ionic liquid, wherein the ionic liquid is a quaternized alkyl imidazoline;

(b) from about 30 wt-% to about 60 wt-% of a polyethylene glycol hardening agent having a molecular weight from about 2000 to about 8000;

(c) from about 0.1 wt-% to about 20 wt-% of a silicate; and (d) from about 0.1 wt-% to about 50 wt-% of an agent selected from the group consisting of a surfactant, solvent, additional functional ingredient and combination thereof, wherein the composition remains solid at room temperature.

8. The cleaning composition of claim 7, wherein the agent is a surfactant.

9. The cleaning composition of claim 7, wherein the surfactant is an ethoxylated alcohol.

10. The cleaning composition of claim 7, wherein the surfactant is an alkyl aryl sulfonate.

11. The cleaning composition of claim 7, wherein the solvent is a glycol ether.

12. The cleaning composition of claim 7, wherein the additional functional ingredient is selected from the group consisting of soil-digesting components, alkaline source, chelating or sequestering agent, a threshold agent or system, disinfectants, detergent fillers, sanitizers, acidulants, complexing agents, biocides, corrosion inhibitors, antiredeposition agents, foam inhibitors, dyes, bleaching agents, bleach activator, optical brighteners, enzymes, enzyme stabilizing systems, thickening or gelling agents, wetting agents, dispersants, stabilizing agents, buffering agent, aesthetic enhancing agent and mixtures thereof.

13. A method of removing soils from a surface, the method comprising:

(a) providing a solid concentrated cleaning composition;

(b) optionally diluting the concentrated solid cleaning composition with water of dilution to form a use solution, wherein the cleaning composition comprises from about 1 wt-% to about 50 wt-% of an ionic liquid selected from the group consisting of isostearyl ethylimidazolinium ethosulfate, oleyl ethylimidazolinium ethosulfate and combinations thereof, from about 30 wt-% to about 60 wt-% of a polyethylene glycol hardening agent having a molecular weight from about 2000 to about 8000, from about 0.1 wt-% to about 20 wt-% of a silicate, from about 0.1 wt-% to about 50 wt-% of an agent selected from the group consisting of a surfactant, solvent, additional functional ingredient and combination thereof, wherein the cleaning composition comprises less than about 0.5% by weight alkyl phenol ethoxylates and is a solid at room temperature; and (c) contacting the surface in need of soil removal with the solid concentrated cleaning composition or the use solution.

14. The method of claim 13, wherein diluting the cleaning composition with water of dilution comprises diluting at weight ratio of cleaning composition to water of dilution of up to about 1:256.

15. The method of claim 13, wherein the use solution of the cleaning composition is low VOC, bio-based and substantially free of alkyl phenol ethoxylates.

16. The method of claim 13, wherein the ionic liquid constitutes between about 10% and about 30% by weight of the cleaning composition.

17. The method of claim 13, wherein the surfactant is an ethoxylated alcohol or an alkyl aryl sulfonate.

* * * * *